US008783944B2

(12) United States Patent
Doi

(10) Patent No.: US 8,783,944 B2
(45) Date of Patent: Jul. 22, 2014

(54) SWITCH DEVICE AND WRISTWATCH

(75) Inventor: Yuji Doi, Hachioji (JP)

(73) Assignee: Casio Computer Co., Ltd., Tokyo (JP)

( * ) Notice: Subject to any disclaimer, the term of this patent is extended or adjusted under 35 U.S.C. 154(b) by 64 days.

(21) Appl. No.: 13/551,934

(22) Filed: Jul. 18, 2012

(65) Prior Publication Data

US 2013/0021880 A1 Jan. 24, 2013

(30) Foreign Application Priority Data

Jul. 22, 2011 (JP) ..... 2011-160651
Jul. 22, 2011 (JP) ..... 2011-160776

(51) Int. Cl.
*G04B 3/00* (2006.01)

(52) U.S. Cl.
USPC ..... 368/319; 368/308; 368/321

(58) Field of Classification Search
USPC ..... 368/206, 216, 308, 319–321, 190
See application file for complete search history.

(56) References Cited

U.S. PATENT DOCUMENTS

2004/0257917 A1* 12/2004 Yoshikawa ..... 368/318
2007/0025190 A1* 2/2007 Cretin ..... 368/319
2007/0076532 A1* 4/2007 Hiranuma et al. ..... 368/319
2008/0112275 A1* 5/2008 Born et al. ..... 368/319
2010/0142333 A1* 6/2010 Hiranuma et al. ..... 368/319
2010/0187074 A1* 7/2010 Manni ..... 200/4
2010/0309756 A1* 12/2010 Kimura et al. ..... 368/293

FOREIGN PATENT DOCUMENTS

JP 2005-108630 4/2005

* cited by examiner

*Primary Examiner* — Amy Cohen Johnson
*Assistant Examiner* — Matthew Powell
(74) *Attorney, Agent, or Firm* — Holtz Holtz Goodman & Chick PC

(57) ABSTRACT

A switch device includes a rotating operation member in which a through-hole is formed in an axial direction; a pressing operation member which is movable within the through-hole of the rotating operation member and press-operable from one opening of the through-hole. The pressing operation member is provided so as to rotate integrally with the rotating operation member, when the rotating operation member rotates. A first coil spring is arranged within the through-hole of the rotating operation member and biases the pressing operation member outwardly in the axial direction. A second coil spring is arranged within the through-hole of the rotating operation member and biases the rotating operation member outwardly in the axial direction.

20 Claims, 14 Drawing Sheets

SWITCH DEVICE AND WRISTWATCH

CROSS-REFERENCE TO RELATED APPLICATION

This application is based upon and claims the benefit of priority from the prior Japanese Patent Applications No. 2011-160651 and No. 2011-160776, both filed Jul. 22, 2011, the entire contents of which are incorporated herein by reference.

BACKGROUND OF THE INVENTION

1. Field of the Invention

The present invention relates to a switch device that is operated by being rotated and a wristwatch including the switch device.

2. Description of the Related Art

As a conventional electronic wristwatch, an electronic wristwatch such as that described in Japanese Patent Application Laid-Open (Kokai) Publication No. 2005-108630 is known, which includes a switch device where the stem is pulled outward to a predetermined position and rotated so that the hands move for time adjustment.

This switch device is structured such that a pressing operation member is slidably and rotatably attached inside a guide pipe provided through the interior of the wristwatch case to the exterior, the stem is integrally provided in the inner edge portion of the pressing operation member, and a cylindrical rotating operation member, which is a winder, is slidably and rotatably attached on the outer periphery of the pressing operation member.

In the normal hand movement state of the switch device where the rotating operation member has been pressed inward and the pressing operation member has been pressed outward from the rotating operation member by the spring force of a coil spring, the user can press the pressing operation member that has been pressed outward against the spring force of the coil spring. When the rotating operation member is pulled outward for time adjustment, the pressing operation member is accordingly pressed outward within the rotating operation member by the spring force of the coil spring. Then, when the rotating operation member is rotated in this state, the pressing operation member rotates along with this rotating operation, whereby a switching operation can be performed.

However, in the structure of this switch device, the pressing operation member is resiliently pressed outward together with the rotating operation member rotatably held thereto by the spring force of the coil spring. Therefore, there is a problem in that when the rotating operation member is rotated and the pressing operation member is rotated in conjunction therewith, the backlash of the rotating operation member occurs easily, whereby the switching action becomes unstable and the rotating operation member cannot be smoothly and favorably rotated.

SUMMARY OF THE INVENTION

An object of the present invention is to provide a switch device whose switching action is stable and which improves switching operation.

In order to achieve the above-described object, in accordance with one aspect of the present invention, there is provided a switch device comprising: a rotating operation member in which a through-hole is formed in an axial direction; a pressing operation member which is movable within the through-hole of the rotating operation member and press-operable from one opening of the through-hole that is provided so as to not slip out of the one opening and integrally rotates with the rotating operation member, when rotating the rotating operation member; a first coil spring which is arranged within the through-hole of the rotating operation member and biases the pressing operation member towards the one opening direction; and a second coil spring which is arranged within the through-hole of the rotating operation member and biases the rotating operation member towards the one opening direction.

The above and further objects and novel features of the present invention will more fully appear from the following detailed description when the same is read in conjunction with the accompanying drawings. It is to be expressly understood, however, that the drawings are for the purpose of illustration only and are not intended as a definition of the limits of the invention.

BRIEF DESCRIPTION OF THE DRAWINGS

FIG. 4A and FIG. 4B are diagrams of a winding stem in the switch device shown in FIG. 2, of which FIG. 4A is an enlarged front view where a portion of the winding stem has been omitted, and FIG. 4B is an enlarged cross-sectional view of the main section of the winding stem taken along line B-B;

FIG. 5A and FIG. 5B are diagrams of a pressing operation member and a rotating operation member in the switch device shown in FIG. 2, of which FIG. 5A is an enlarged cross-sectional view thereof, and FIG. 5B is an enlarged side view thereof when viewed from the right-hand side;

FIG. 6A and FIG. 6B are diagrams of the pressing operation member shown in FIG. 5A and FIG. 5B, of which FIG. 6A is an enlarged front view thereof where the upper half is shown by cross-sectional view, and FIG. 6B is an enlarged side view of the half of the pressing operation member when viewed from the right-hand side;

FIG. 7A and FIG. 7B are diagrams showing the operation section of the pressing operation member in FIG. 5A and FIG. 5B, of which FIG. 7A is an enlarged side view thereof when viewed from the left-hand side, and FIG. 7B is an enlarged front view thereof;

FIG. 8A and FIG. 8B are diagrams of the rotating operation member shown in FIG. 5A and FIG. 5B, of which FIG. 8A is an enlarged cross-sectional view thereof, and FIG. 8B is an enlarged side view of the half of the rotating operation member when viewed from the right-hand side;

FIG. 9A and FIG. 9B are diagrams of an interlocking pipe in the rotating operation member shown in FIG. 5A and FIG. 5B, of which FIG. 9A is an enlarged cross-sectional view thereof, and FIG. 9B is an enlarged side view of the half of the interlocking pipe when viewed from the right-hand side;

DETAILED DESCRIPTION OF THE PREFERRED EMBODIMENTS

An embodiment in which the present invention has been applied to a pointer-type electronic wristwatch will hereinafter be described with reference to FIG. 1 to FIG. 14.

Figure 1:
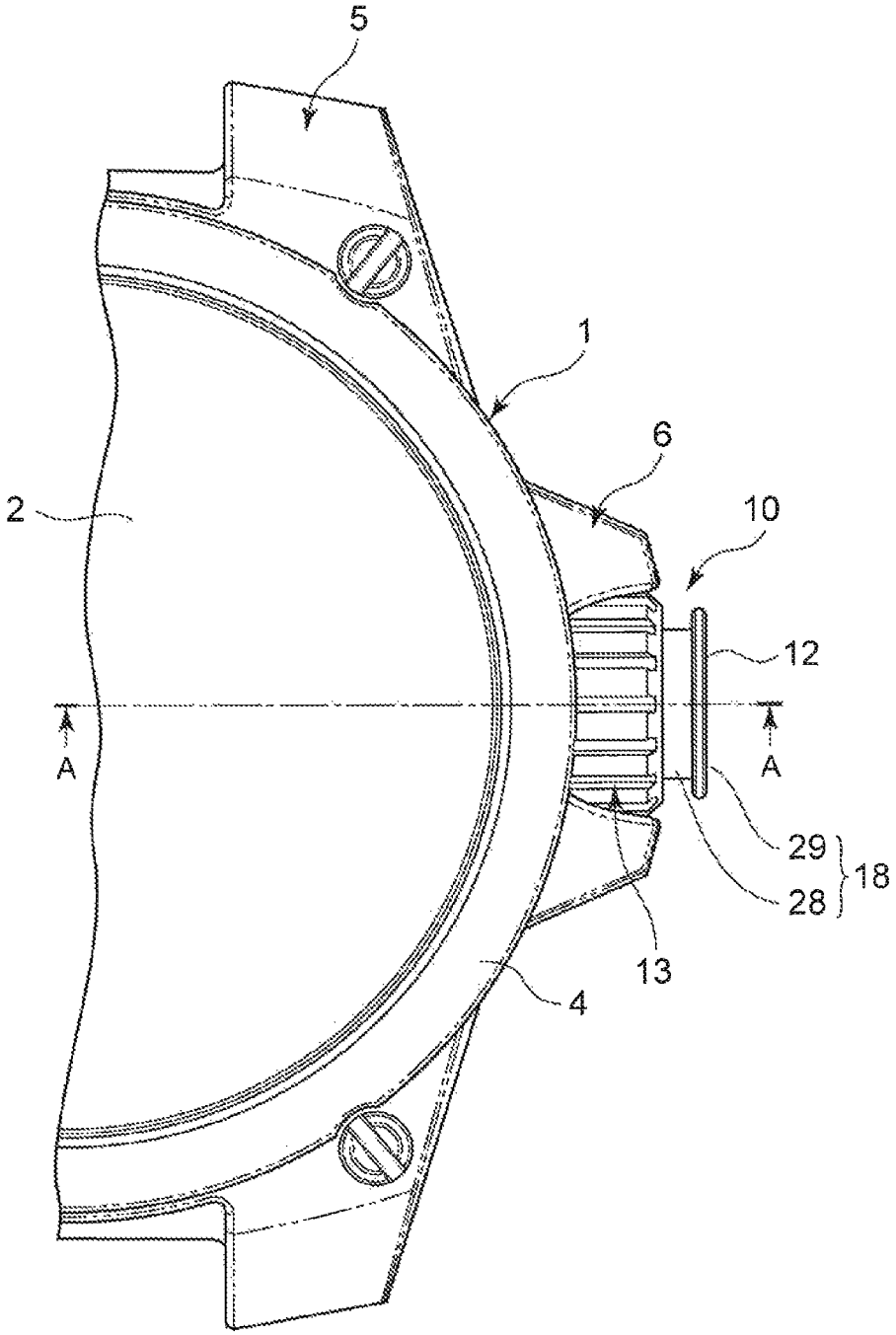
FIG. 1 is an enlarged planar view of the main section of an embodiment in which the present invention has been applied to a pointer-type electronic wristwatch.
Figure 2:
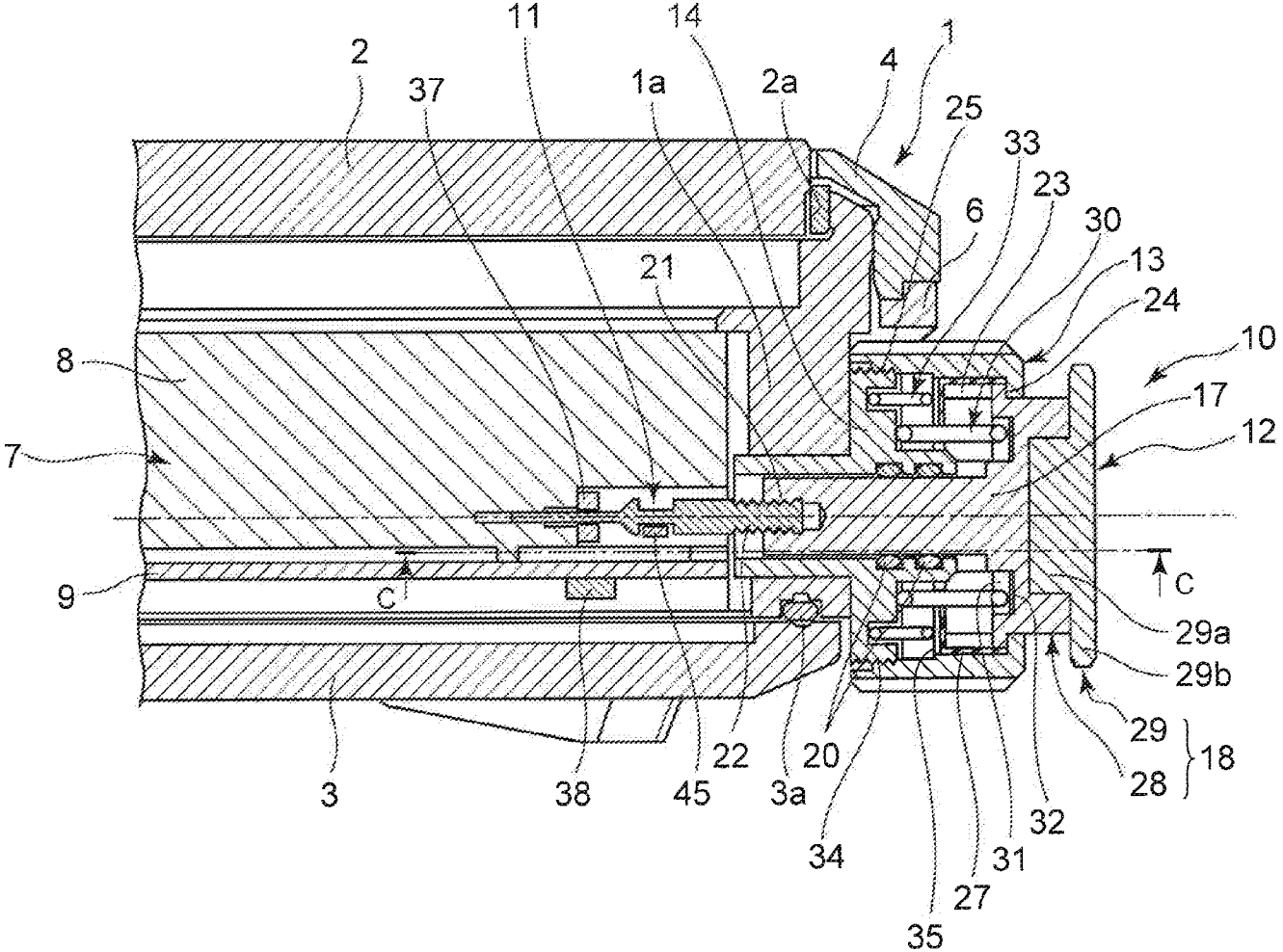
FIG. 2 is an enlarged cross-sectional view of the main section of the electronic wristwatch taken along line A-A in FIG. 1.

As shown in FIG. 1 and FIG. 2, this electronic wristwatch includes a wristwatch case 1. The wristwatch case 1 has a crystal 2 attached to the upper opening portion thereof via a gasket 2*a*, and a case back 3 attached to the underside thereof via a waterproofing ring 3*a*.

In addition, the wristwatch case 1 has a bezel 4 provided on the upper outer peripheral portion thereof, as shown in FIG. 1 and FIG. 2. On portions of the side wall surface of the wristwatch case 1 corresponding to the 12 o'clock position and the 6 o'clock position, band attaching sections 5 are provided projecting outward. Also, on a portion of the side wall surface corresponding to the 3 o'clock position, a switch protecting section 6 is provided projecting outward.

Inside the wristwatch case 1, a timepiece module 7 is provided as shown in FIG. 2. The timepiece module 7 includes a housing 8, and the housing 8 is provided with a timepiece movement (not shown) that moves the hands and a switch device 10 for time adjustment.

In this instance, the hands (not shown) include an hour hand, a minute hand, a second hand, and a function hand. These hands are attached to hand spindles positioned on the same axis, and moved along with the rotation of the hand spindles, respectively. On the undersurface of the housing 8 of the timepiece module 7, a circuit board 9 is mounted on which an electronic circuit for driving and controlling the entire timepiece is arranged, as shown in FIG. 2.

The switch device 10 includes a winding stem 11, a pressing operation member 12, a rotating operation member 13, and a guide pipe 14 as shown in FIG. 2, and is provided on the 3 o'clock side of the wristwatch case 1 as shown in FIG. 1. The inner end portion (left end portion in FIG. 2) of the winding stem 11 is rotatably and slidably arranged inside the housing 8 of the timepiece module 7, and the outer end portion (right end portion in FIG. 2) is inserted into the guide pipe 14 to be attached to the pressing operation member 12.

The inner end portion side (left end portion side in FIG. 2) of the pressing operation member 12 is inserted into the guide pipe 14, and the outer end portion side (right end portion side in FIG. 2) projects outside of the wristwatch case 1, as shown in FIG. 2. The rotating operation member 13 is attached to the outer peripheral portion of the pressing operation member 12 which projects outside of the wristwatch case 1 so as to be slidable along the axial direction thereof and to be rotatable integrally therewith.

Figure 3:
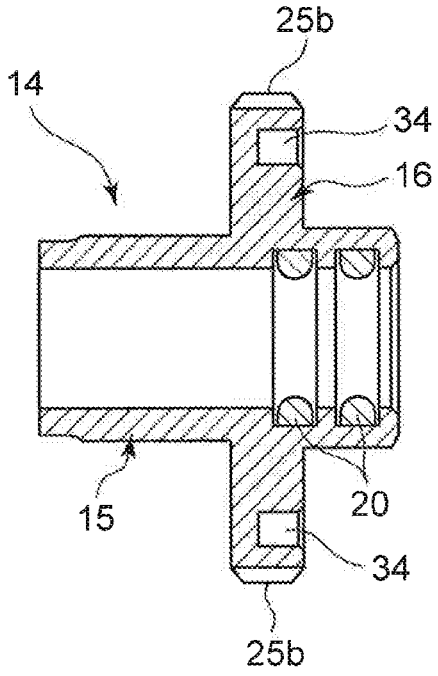
FIG. 3 is an enlarged cross-sectional view of the main section of a guide pipe in the switch device shown in FIG. 2.

The guide pipe 14 includes a pipe main body 15 that is provided through the interior of a side wall section 1*a* of the wristwatch case 1 to the exterior, and a flange section 16 that is provided on the outer peripheral surface of the pipe main body 15 and comes in contact with the outer surface of the side wall section 1*a* of the wristwatch case 1, as shown in FIG. 2 and FIG. 3. In this instance, the pipe main body 15 is formed such that the inner end portion slightly protrudes from the inner surface of the side wall section 1*a* of the wristwatch case 1, and the outer end portion largely protrudes from the outer surface of the side wall section 1*a* of the wristwatch case 1.

Figure 5A:
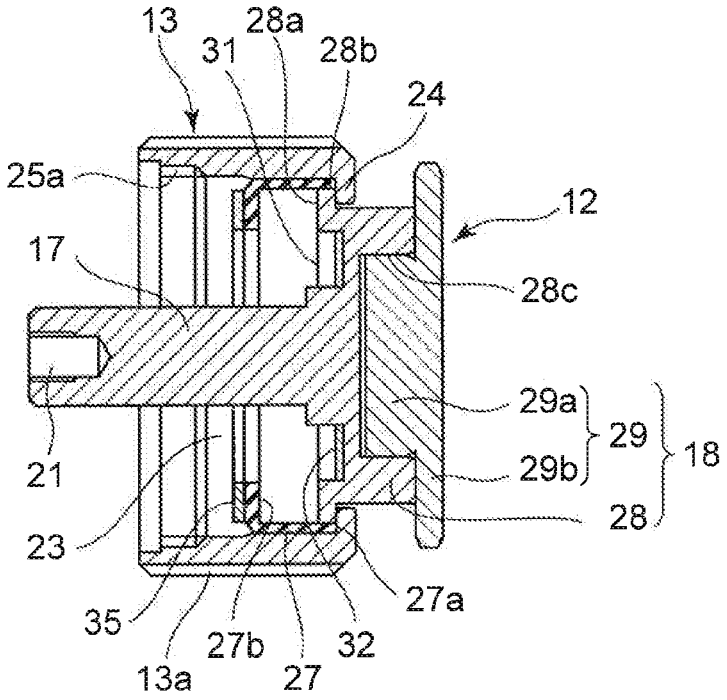

As shown in FIG. 2, the inner end portion side (left end portion side in FIG. 2) of the pressing operation member 12 is inserted into the pipe main body 15 of the guide pipe 14. This pressing operation member 12 includes a shaft section 17 formed to have an outer diameter almost equal to the inner diameter of the pipe main body 15, and a winder section 18 provided in the outer end portion (right end portion in FIG. 2) of the shaft section 17 and whose diameter is greater than that of the shaft section 17, as shown in FIG. 2 and FIG. 5A.

The shaft section 17 of the pressing operation member 12 is slidably and rotatably attached to the inside of the pipe main body 15 of the guide pipe 14 via a pair of waterproofing rings 20 for ensuring waterproofing, as shown in FIG. 2. In this instance, the pair of waterproofing rings 20 are embedded in the outer side of the inner peripheral surface of the pipe main body 15 of the guide pipe 14, as shown in FIG. 3.

Figure 4A:
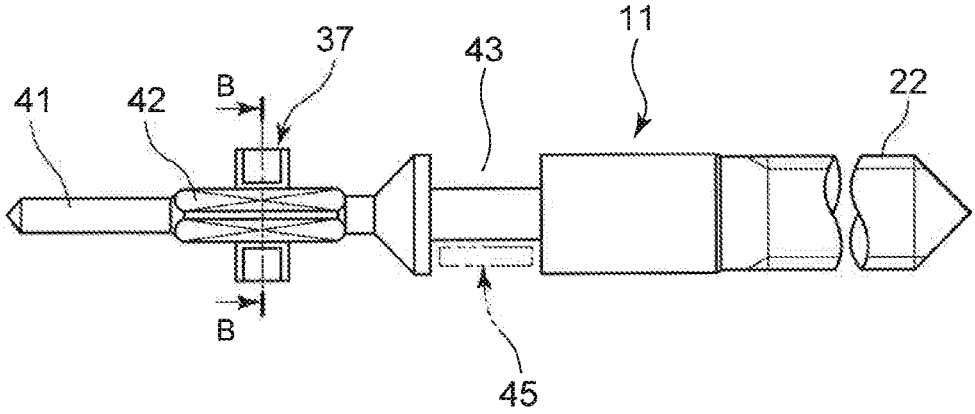
Figure 6A:
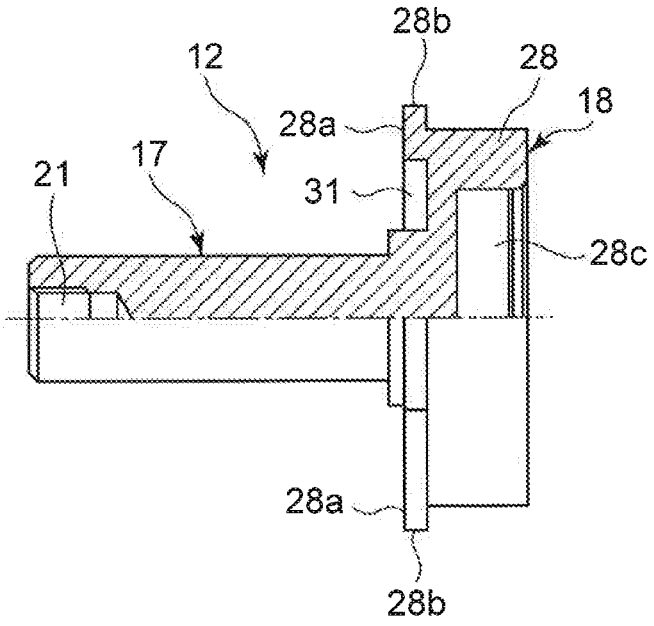

As also shown in FIG. 2, the outer end portion of the winding stem 11 is connected to the inner end portion of the pressing operation member 12. That is, a screw hole 21 is provided in the inner end portion of the pressing operation member 12 along the axial direction, as shown in FIG. 5A and FIG. 6A, and a screw section 22 that is threadably engaged with the screw hole 21 of the pressing operation member 12 is provided in the outer end portion of the winding stem 11, as shown in FIG. 4A.

As a result, the outer end portion of the winding stem 11 is attached to the inner end portion of the shaft section 17 within the guide pipe 14, by the screw section 22 in the outer end portion of the winding stem 11 being screwed into the screw hole 21 in the inner end portion of the shaft section 17, as shown in FIG. 2. In this state, the pressing operation member 12 slides along the axial direction and rotates, integrally with the winding stem 11.

Figure 5B:
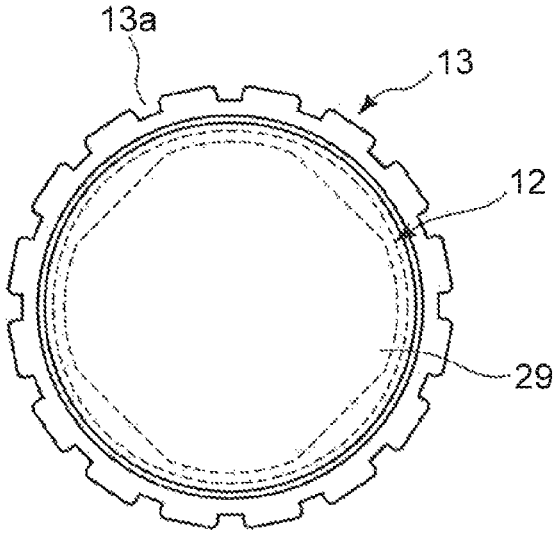

On the other hand, the rotating operation member 13 is formed into a substantially cylindrical shape, into which the pressing operation member 12 positioned outside of the wristwatch case 1 and the flange section 16 of the guide pipe 14 are inserted, as shown in FIG. 2, FIG. 5A and FIG. 5B. On the outer peripheral surface of this rotating operation member 13, a plurality of groove sections 13*a* for slip-proofing are provided at even intervals along the circumferential direction, as shown in FIG. 8A and FIG. 8B.

Figure 8A:
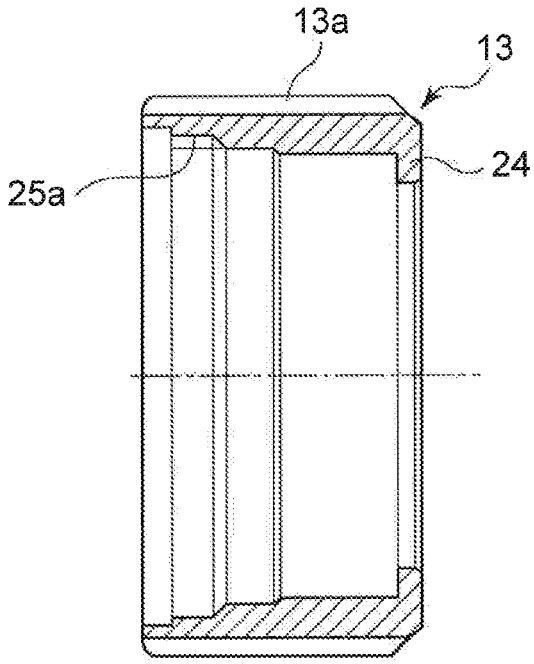
Figure 8B:
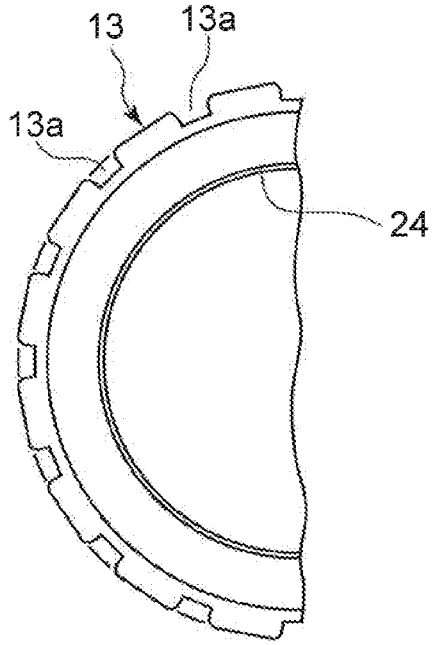

Also, the rotating operation member 13 has a through-hole 23 whose inner diameter is almost equal to the outer diameter of the flange section 16 of the guide pipe 14, which is formed passing through the rotating operation member 13 in the axial direction, as shown in FIG. 2 and FIG. 8A. In an opening on the outer side (right side in FIG. 8A) of this through-hole 23, a detachment-preventing shoulder section 24 that prevents the pressing operation member 12 from slipping out of the through-hole 23 towards the outer side (right side in FIG. 2) of the wristwatch case 2 is provided, as shown in FIG. 5A and FIG. 8A.

This detachment-preventing shoulder section 24 is structured such that a stopper section 28*a* provided in the winder section 18 of the pressing operation member 12 comes in contact with it from the inner side, whereby the pressing operation member 12 does not slip out of the through-hole 23 towards the outer side (right side in FIG. 5A) of the wristwatch case 1, as shown in FIG. 2 and FIG. 5A.

Also, when the rotating operation member 13 is pressed inward with the pressing operation member 12, the rotating operation member 13 is locked to the guide pipe 14 by a locking section 25, as shown in FIG. 2. That is, the locking section 25 includes a female screw section 25*a* provided on the inner peripheral surface of the opening on the inner side (left side in FIG. 8A) of the through-hole 23 of the rotating operation member 13 shown in FIG. 8A, and a male screw section 25*b* provided on the outer peripheral surface of the flange section 16 of the guide pipe 14 shown in FIG. 3, and the female screw section 25*a* of the rotating operation member 13 is detachably threadably engaged with the male screw section 25*b* of the guide pipe 14, as shown in FIG. 2.

The through-hole 23 of the rotating operation member 13 has an interlocking pipe 27 fitted thereinto, as shown in FIG. 5A. This interlocking pipe 27 fixed within the through-hole 23 of the rotating operation member 13 is used to transmit the rotation of the rotating operation member 13 to the pressing operation member 12. That is, the outer diameter of the interlocking pipe 27 is formed to be almost the same size as the inner diameter of the through-hole 23 of the rotating operation member 13.

Figure 9A:
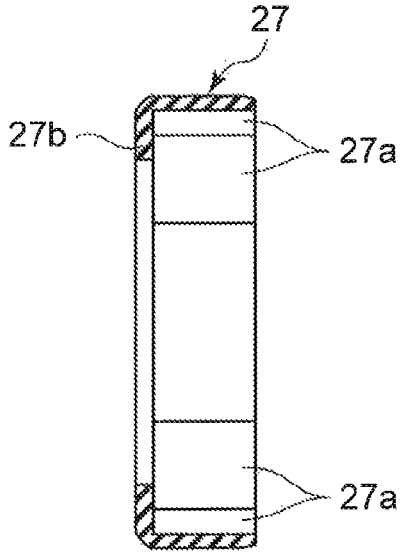
Figure 9B:
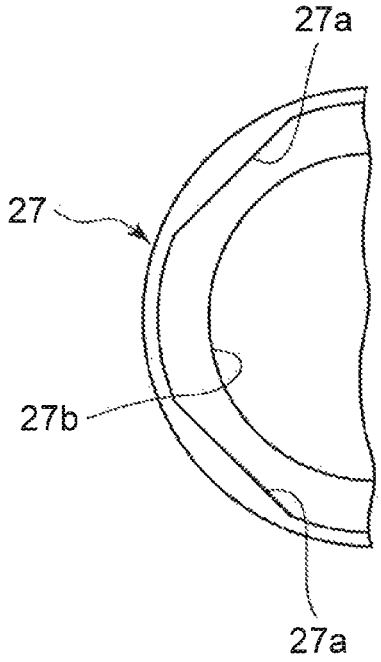

The axial-direction length of the interlocking pipe 27 is almost half that of the rotating operation member 13, and a ring-shaped shoulder section 27*b* is provided in the inner end portion, as shown in FIG. 5A. On the inner peripheral surface of the interlocking pipe 27, a recessing and projecting section 27*a* is provided, as shown in FIG. 9A and FIG. 9B. Along with this, a recessing and projecting section 28*b* described later that engages with the recessing and projecting section 27*a* of the interlocking pipe 27 is provided on the outer peripheral surface of the stopper section 28*a* in the winder section 18 of the pressing operation member 12, as shown in FIG. 6B.

In this instance, the winder section 18 of the pressing operation member 12 has a projecting section 28 that is inserted into the detachment-preventing shoulder section 24 of the rotating operation member 13 and projects outward, and an operation section 29 attached to the projecting section 28, as shown in FIG. 2 and FIG. 5A. On the inner end portion (left end portion in FIG. 5A) of the outer peripheral surface of the projecting section 28, the stopper section 28*a* that comes in contact with the inner wall surface of the detachment-preventing shoulder section 24 of the rotating operation member 13 is provided, as shown in FIG. 5A, FIG. 6A and FIG. 6B.

Figure 6B:
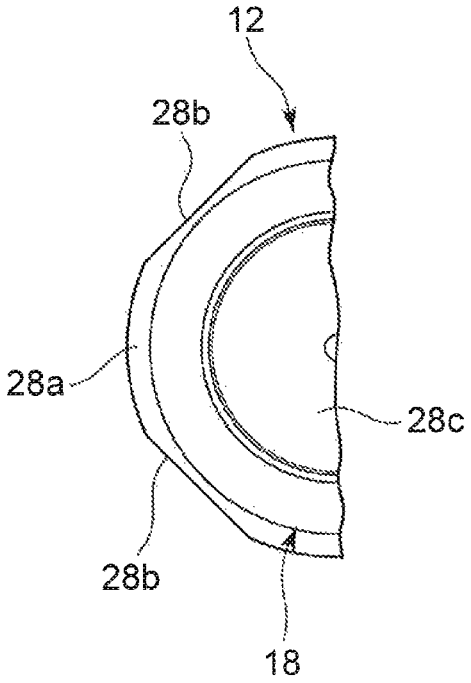

On the outer peripheral surface of the stopper section 28*a* of the projecting section 28, the recessing and projecting section 28*b* that engages with the recessing and projecting section 27*a* of the interlocking pipe 27 is provided, as shown in FIG. 6A and FIG. 6B. As a result, the recessing and projecting section 28*b* on the outer peripheral portion of the projecting section 28 engages with the recessing and projecting section 27*a* of the interlocking pipe 27, and thereby enables the projecting section 28 to slide in the axial direction within the interlocking pipe 27 and integrally rotate with the interlocking pipe 27.

Figure 7A:
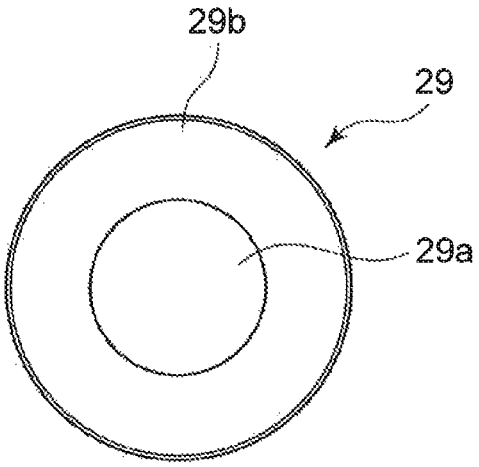
Figure 7B:
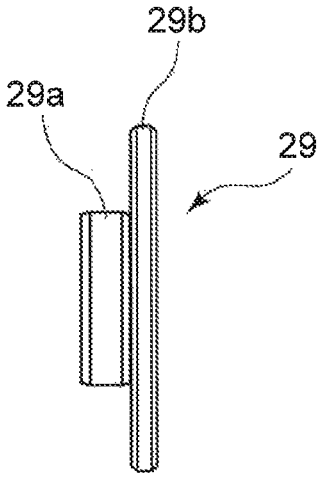

The operation section 29 includes an attachment projecting section 29*a* attached to the outer end surface of the projecting section 28 and an interlocking projecting section 29*b* provided on the attachment projecting section 29*a*, as shown in FIG. 5A, FIG. 7A and FIG. 7B. The attachment projecting section 29*a* is fitted by press-fitting into an attachment recessing section 28*c* provided on the outer end surface of the projecting section 28 and fixed thereto. The interlocking projecting section 29*b* comes in contact with the outer end portion of the rotating operation member 13 when the pressing operation member 12 is pressed from outside. This interlocking projecting section 29*b* is formed to be almost the same size as or slightly smaller than the outer peripheral portion of the rotating operation member 13.

As a result, the pressing operation member 12 is structured to, when the operation section 29 of the winder section 18 exposed outside of the rotating operation member 13 is press-operated, slide within the interlocking pipe 27 along the axial direction, with the recessing and projecting section 28*b* of the stopper section 28*a* of the projecting section 28 being engaged with the recessing and projecting section 27*a* of the interlocking pipe 27, as shown in FIG. 2 and FIG. 5A.

Also, since the recessing and projecting section 28*b* of the stopper section 28*a* of the projecting section 28 is in engagement with the recessing and projecting section 27*a* of the interlocking pipe 27, the pressing operation member 12 is structured to integrally rotate with the interlocking pipe 27 without slipping when the interlocking pipe 27 rotates along with the rotating operation of the rotating operation member 13, as shown in FIG. 2 and FIG. 5A.

Figure 11:
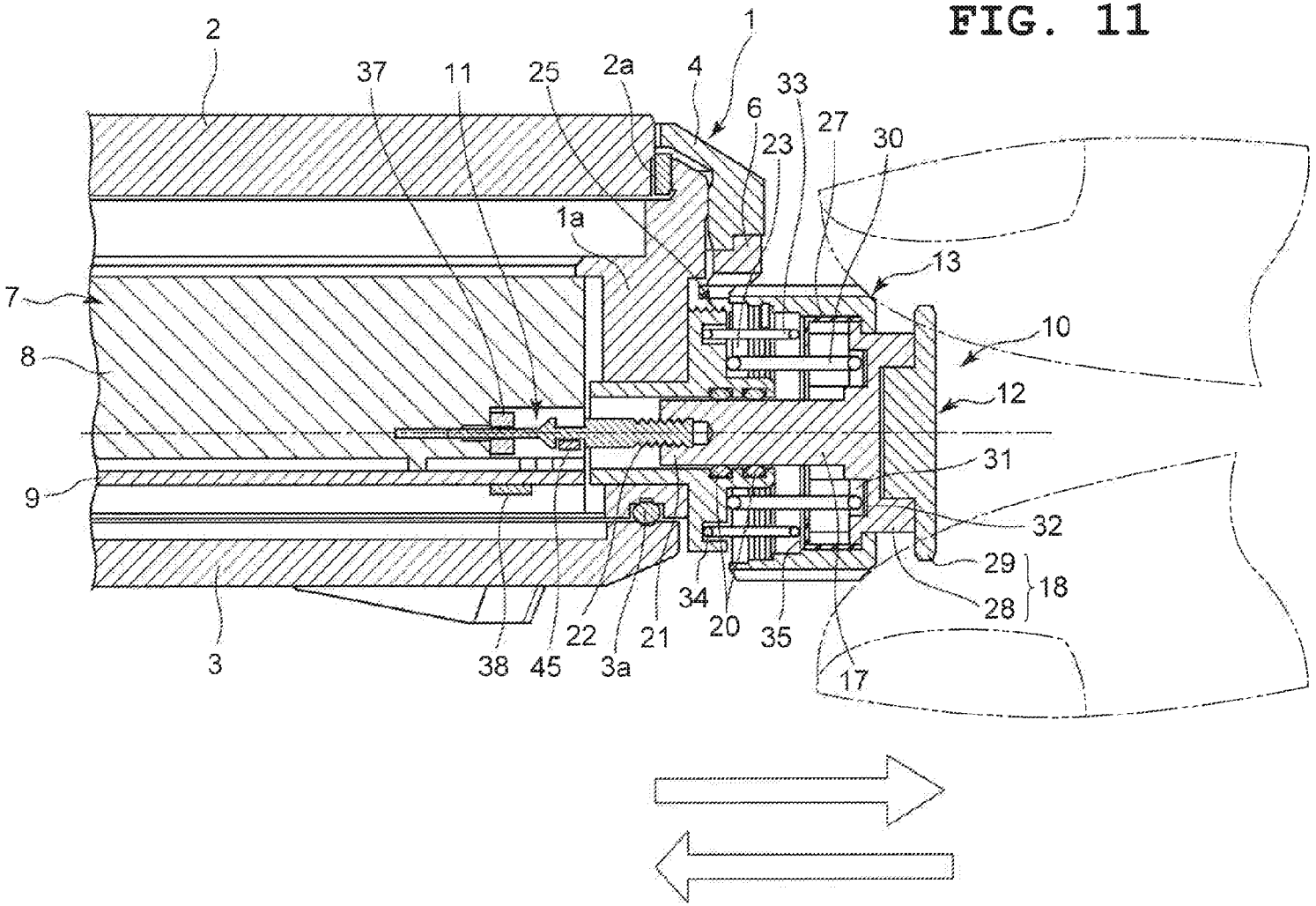
FIG. 11 is an enlarged cross-sectional view showing the main section of the switch device of the electronic wristwatch in FIG. 2, in which the rotating operation member is being pulled outward.

Moreover, the pressing operation member 12 is structured such that, when pressing and locking the rotating operation member 13 after pulling it outward, fingertips holding the rotating operation member 13 come in contact with the outer peripheral portion of the interlocking projecting section 29*b* of the operation section 29, and presses the operation section 29, whereby the pressing operation member 12 is pressed inward together with the rotating operation member 13, as shown in FIG. 11.

As shown in FIG. 2, the pressing operation member 12 is biased (energized) towards the opening on the outer end portion side (right side in FIG. 2) of the through-hole 23 of the rotating operation member 13 by a first coil spring 30. This first coil spring 30 is arranged between the winder section 18 of the pressing operation member 12 and the flange section 16 of the guide pipe 14 while being positioned around the outer periphery of the shaft section 17 of the pressing operation member 12 projecting outside of the wristwatch case 1.

In this instance, the first coil spring 30 is structured such that the inner end portion (left end portion in FIG. 2) thereof comes in contact with the outer surface of the flange section 16 of the guide pipe 14, and the outer end portion (right end portion in FIG. 2) thereof is resiliently inserted into a first mounting groove 31 provided on the inner surface of the winder section 18 of the pressing operation member 12, via a first sliding member 32, as shown in FIG. 2 and FIG. 5A.

This first coil spring 30 is restricted to a predetermined position between the winder section 18 of the pressing operation member 12 and the flange section 16 of the guide pipe 14 by the first mounting groove 31 provided on the inner surface of the winder section 18 of the pressing operation member 12, as shown in FIG. 2 and FIG. 5A. The first sliding member 32 is a circular disk-shaped washer made of a synthetic resin having slidability and low surface friction resistance, such as a fluorine-based resin or a polyethylene-based resin.

As a result, the pressing operation member 12 is structured such that, when the interlocking pipe 27 rotates along with the rotating operation of the rotating operation member 13, the first coil spring 30 slides in the rotation direction with the outer end portion (right end portion in FIG. 2) thereof being resiliently in contact with the first sliding member 32, whereby the pressing operation member 12 smoothly rotates with the interlocking pipe 27, in spite of the winder section 18 of the pressing operation member 12 being biased towards the outer side (right side in FIG. 2) of the wristwatch case 1 by the spring force of the first coil spring 30, as shown in FIG. 2.

Also, the rotating operation member 13 is biased towards the outer end portion side (right side in FIG. 2) of the side wall section 1*a* of the wristwatch case 1 by a second coil spring 33, as shown in FIG. 2. This second coil spring 33 is arranged between the interlocking pipe 27 and the flange section 16 of the guide pipe 14 and positioned in the outer periphery of the first coil spring 30.

In this instance, the second coil spring 33 is structured such that the inner end portion (left end portion in FIG. 2) thereof is inserted into a second mounting groove 34 provided in the outer surface (right side surface in FIG. 2) of the flange section 16 of the guide pipe 14, and the outer end portion (right end portion in FIG. 2) thereof resiliently comes in contact with the end surface of the interlocking pipe 27 on the inner side via a second sliding member 35, as shown in FIG. 2 and FIG. 5A.

This second coil spring 33 is restricted to a predetermined position between the interlocking pipe 27 and the flange section 16 of the guide pipe 14 by the second mounting groove 34 provided on the outer surface of the flange section 16 of the guide pipe 14, as shown in FIG. 2 and FIG. 5A. The second sliding member 32 is a circular disk-shaped washer made of a synthetic resin having slidability and low surface friction resistance, such as a fluorine-based resin or a polyethylene-based resin, as in the case of the first sliding member 32.

As a result, rotating operation member 13 is structured as shown in FIG. 2, in which, when the female screw section 25*a* is unscrewed from the male screw section 25*b* provided in the flange section 16 of the guide pipe 14 along with the rotating operation of the rotating operation member 13, the interlocking pipe 27 is pressed outward by the spring force of the second coil spring 33 as shown in FIG. 11, whereby the rotating operation member 13 is pressed outward with the pressing operation member 12.

Also, the rotating operation member 13 is structured such that, when it rotates along with a rotating operation, the second coil spring 33 slides in the rotation direction with the outer end portion (right end portion in FIG. 11) thereof being resiliently in contact with the second sliding member 35, whereby it smoothly rotates with the interlocking pipe 27, in spite of the interlocking pipe 27 being biased towards the outer side (right side in FIG. 11) of the wristwatch case 1 by the spring force of the second coil spring 33, as shown in FIG. 11.

Figure 4B:
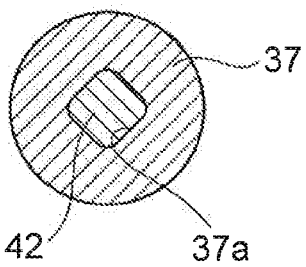
Figure 10:
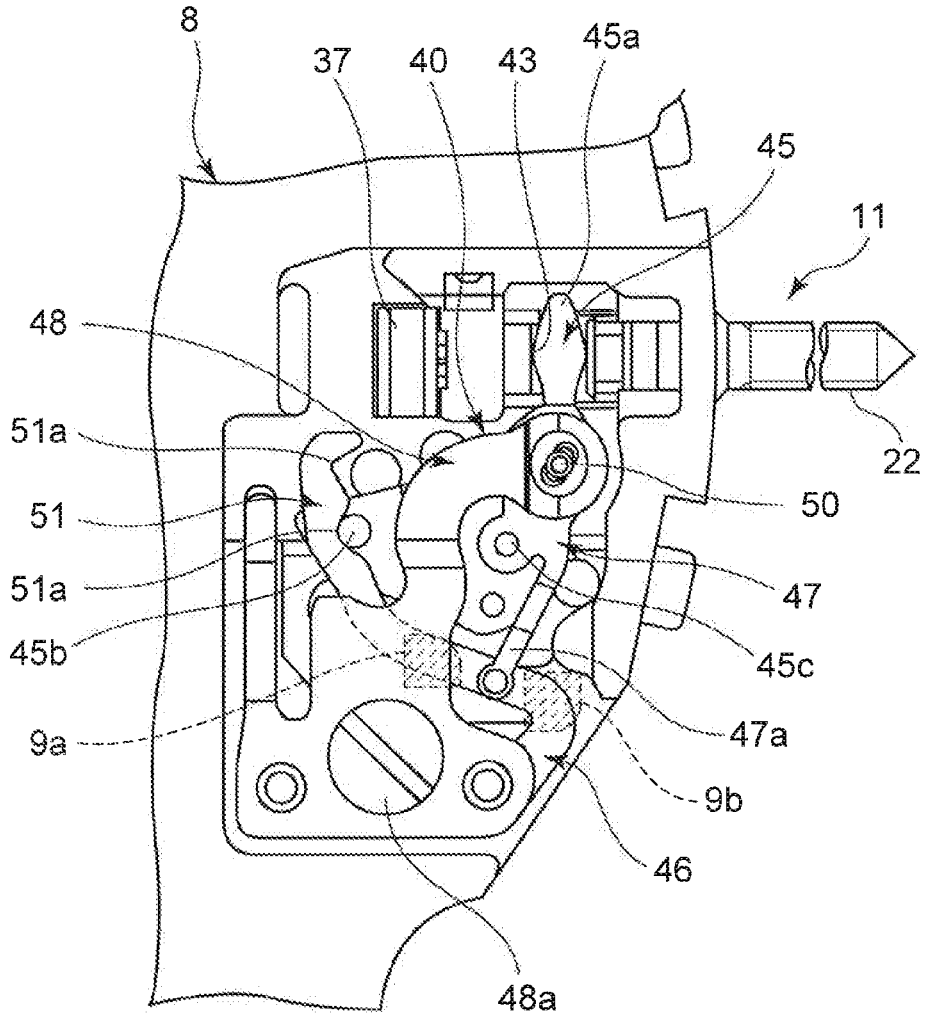
FIG. 10 is an enlarged bottom view of the main section of a position restricting member in the switch device taken along line C-C in FIG. 2.

As shown in FIG. 2, FIG. 4A and FIG. 4B, the winding stem 11 has a magnet 37, which is provided on the inner side (left side in FIG. 2) of a portion of the winding stem 11 positioned inside the housing 8 of the timepiece module 7. In the structure of the winding stem 11, when the magnet 37 rotates with the winding stem 11, a magnetic sensor 38 detects a change in the magnetic field generated by the magnet 37. Also, a position restricting member 40 restricts the sliding position of the winding stem 11 in the axial direction, and a switch is switched depending on the sliding position thereof, as shown in FIG. 10.

That is, in a portion of the winding stem 11 positioned inside the housing 8, a guide shaft section 41, a slide shaft section 42, and an engaging groove section 43 are provided in order from the inner end portion side (left end portion side in FIG. 2), as shown in FIG. 2, FIG. 4A and FIG. 4B. The guide shaft section 41 is slidably and rotatably arranged inside a guide hole 44 provided inside the housing 8.

The slide shaft section 42 is formed into a square bar having a rectangular cross-sectional shape, to which the magnet 37 is attached so as to be slidable along the axial direction and integrally rotatable with the slide shaft section 42, as shown in FIG. 4A and FIG. 4B. The engaging groove section 43 is a ring-shaped recessing groove provided in the winding stem 11, and enables a setting lever 45 of the position restricting member 40 which is described later to rotate based on a sliding movement of the winding stem 11.

As shown in FIG. 2, FIG. 4A and FIG. 4B, the magnet 37 has a square-shaped hole 37*a* provided in its center, and the housing 8 restricts the axial-direction movement of the magnet 37 with the slide shaft section 42 of the winding stem 11 being slidably positioned in the hole 37*a*. That is, because the slide shaft section 42 slides in relation to the magnet 37, when the winding stem 11 slides, the position of the slide shaft section 42 in the axial direction is restricted by the housing 8, whereby the magnet 37 rotates at a predetermined position consistently.

The magnetic sensor 38 is provided on the undersurface of the circuit board 9 provided on the undersurface of the housing 8, corresponding to the magnet 37, as shown in FIG. 2. This magnetic sensor 38 is constituted by two magnetic detection elements, such as magneto resistance [MR] elements, and an integrated chip (IC) that digitalizes outputs from the MR elements housed within a single package. These two MR elements detect change in magnetic field which is occurred along with the rotation of the magnet 37, and outputs two types of detection signals, high (H) and low (L).

That is, because the setting positions of the two MR elements of the magnetic sensor 38 differ, when change in magnetic field accompanying the rotation of the magnet 37 is detected, a phase difference occurs in the outputs, and two types of detection signals are outputted as a result of this phase difference, whereby the rotation of the magnet 37 is detected. In this instance, a microcomputer (not shown) mounted to the circuit board 9 analyzes the two types of detection signals and calculates a rotation angle (amount of rotation) of the magnet 37.

In addition, the magnetic sensor 38 detects the rotation direction of the magnet 37 (whether forward rotation or reverse direction), and detects whether or not the forward or reverse rotation of the magnet 37 is continuous. Then, the microcomputer of the circuit board 9 rotates the hands in the forward direction (clockwise direction) or the reverse direction (counter-clockwise direction) based on detection signals indicating the rotation direction detected by the magnetic sensor 38. In addition, when the rotation is continuous, the microcomputer rapidly rotates the hands in the forward direction (clockwise direction) or the reverse direction (counter-clockwise direction) based on detection signals indicating whether or not the rotation of the magnet 37 detected by the magnetic sensor 38 is continuous.

On the other hand, the position restricting member 40 that restricts the position of the winding stem 11 includes the setting lever 45, a setting lever spring 46, a switch plate 47, and a pressing plate 48, as shown in FIG. 10. The setting lever 45 formed into a plate shape is rotatably attached to the housing 8 and rotates corresponding to the movement of the winding stem 11 in the axial direction, as shown in FIG. 10. More specifically, the setting lever 45 is attached to a supporting shaft 50 provided upright on the housing 8 so as to be rotatable in the planar direction of the housing 8.

This setting lever 45 is provided with an interlocking arm section 45*a* that is arranged inside the engaging groove section 43 of the winding stem 11, an interlocking pin 45*b* whose position is resiliently restricted by the setting lever spring 46, and a connecting pin 45*c* that enables the switch plate 47 to rotate together with the setting lever 45, as shown in FIG. 10. As a result, when the winding stem 11 moves in the axial direction, the interlocking arm section 45*a* swings along with the movement of the engaging groove section 43 of the winding stem 11, whereby the setting lever 45 rotates around the supporting shaft 50, as shown in FIG. 10.

The setting lever spring 46 is a flat spring fixed to a portion of the housing 8 near the setting lever 45, as shown in FIG. 10. This setting lever spring 46 resiliently holds the interlocking pin 45*b* of the setting lever 45 to restrict the position thereof, and thereby resiliently restricts the rotation position of the setting lever 45 and the movement position of the winding stem 11 in the axial direction. That is, the setting lever spring 46 has a position restricting section 51 provided in the tip end portion thereof which resiliently holds the interlocking pin 45*b* of the setting lever 45, as shown in FIG. 10.

This position restricting section 51 is provided with a plurality of locking recessing sections 51*a* that resiliently lock the interlocking pin 45*b*, as shown in FIG. 10. As a result, the setting lever spring 46 is structured such that, when the winding stem 11 is in a first position (normal hand movement state) as a result of being pressed inward, the interlocking pin 45*b* of the setting lever 45 is resiliently locked by one of the locking recess sections 51*a* of the position restricting section 51, whereby the winding stem 11 is restricted to the first position, as shown in FIG. 10.

Figure 12:
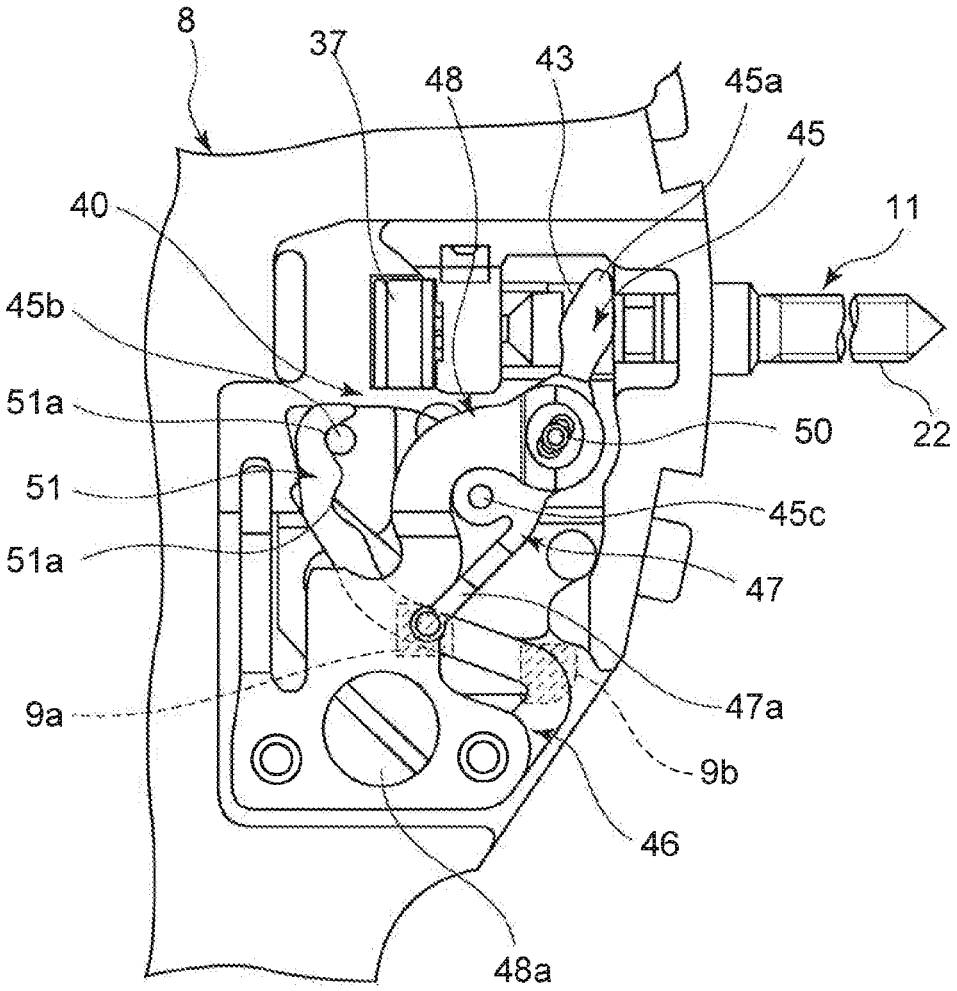
FIG. 12 is an enlarged bottom view of the position restricting member in FIG. 10 when the rotating operation member has been pulled outward for time adjustment.

Also, the setting lever spring 46 is structured such that the setting lever 45 rotates when the winding stem 11 is moved to a second position (position for time adjustment state) by being pulled outward in the axial direction, the interlocking pin 45*b* resiliently deforms the position restricting section 51 of the setting lever spring 46 by rotating and moving along with this rotation, and one of the locking recessing sections 51*a* of the resiliently deformed position restricting section 51 resiliently locks the interlocking pin 45*b* of the setting lever 45, whereby the winding stem 11 is restricted to the second position, as shown in FIG. 12.

Figure 13:
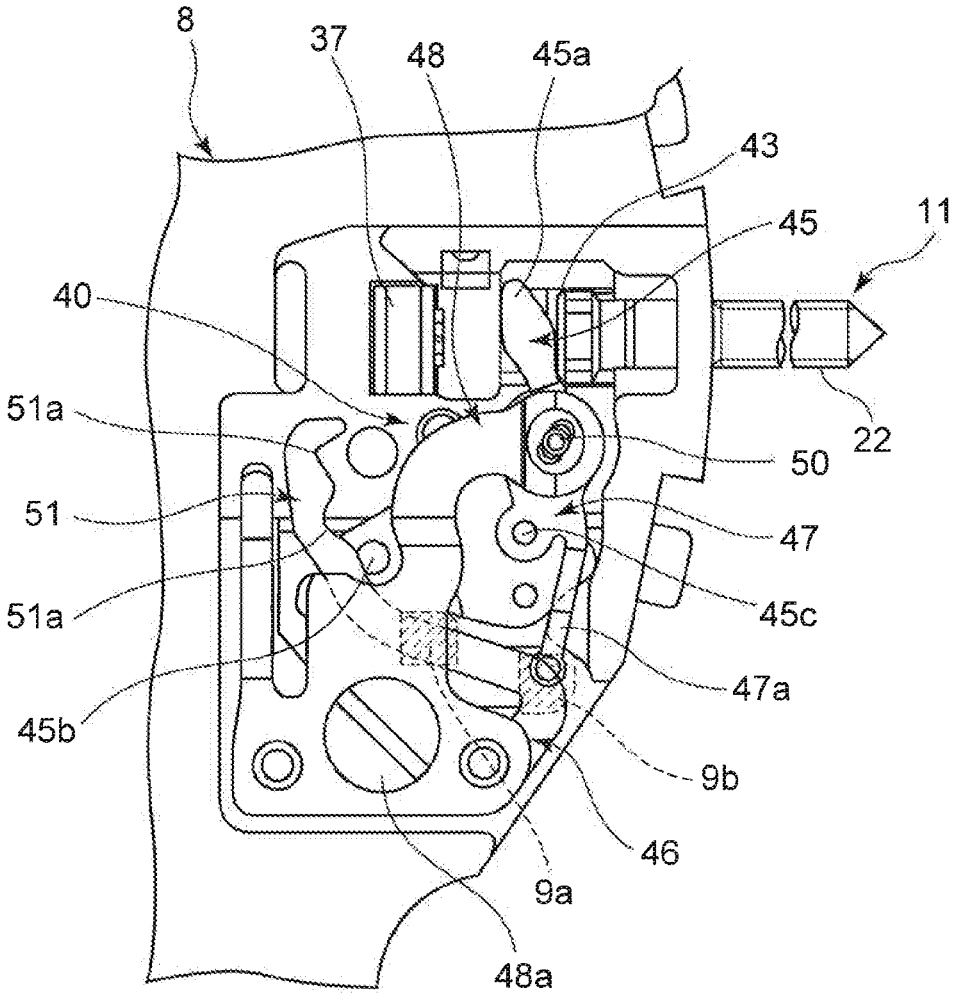
FIG. 13 is an enlarged bottom view of the position restricting member in FIG. 10 when switching action has been performed by the pressing operation member being press-operated.

Moreover, the setting lever spring 46 is structured such that the setting lever 45 rotates when the winding stem 11 is moved from the first position (normal hand movement state) shown in FIG. 10 where it has been pressed inward to a third position (other function state) shown in FIG. 13 by being pressed further inward, the interlocking pin 45*b* resiliently deforms the position restricting section 51 of the setting lever spring 46 by rotating and moving along with this rotation, and the resiliently deformed position restricting section 51 resiliently locks the interlocking pin 45*b* of the setting lever 45, whereby the winding stem 11 is restricted to the third position, as shown in FIG. 13.

The switch plate 47 is constituted by a metal plate and is rotatably attached to the supporting shaft 50 together with the setting lever 45, as shown in FIG. 10. This switch plate 47 is provided with a contact spring section 47*a* that comes in contact with the top surface of the circuit board 9 and slides thereon, which extends toward the opposite side of the interlocking arm section 45*a* of the setting lever 45, as shown in FIG. 10. The connecting pin 45*c* is inserted into a predetermined place of this switch plate 47.

As a result, the switch plate 47 is structured such that it rotates and moves together with the setting lever 45 with the tip end portion of the contact spring section 47*a* being in contact with the top surface of the circuit board 9, whereby the tip end portion of the contact spring section 47*a* comes in contact with one of the contact sections 9*a* and 9*b* provided on the top surface of the circuit board 9, and the contact position is switched, as shown in FIG. 10.

That is, the switch plate 47 is structured such that it rotates and moves with the setting lever 45 when the winding stem 11 is pressed inward to the first position (normal hand movement state) and the setting lever 45 is rotated, whereby the contact spring 47*a* is moved to a position between the contact sections 9*a* and 9*b* provided on the top surface of the circuit board 9 where it does not touch either one of the contact sections 9*a* and 9*b*, and the normal hand movement mode is maintained, as shown in FIG. 10.

In addition, the switch plate 47 is structured such that it rotates and moves with the setting lever 45 when the winding stem 11 is pulled outward to the second position (time adjustment state) and the setting lever 45 is rotated, whereby the contact spring section 47*a* comes in contact with one contact section 9*a* provided on the top surface of the circuit board 9, and the operating mode is switched from the normal hand movement mode to the time adjustment mode, as shown in FIG. 12.

Moreover, the switch plate 47 is structured such that it rotates and moves with the setting lever 45 when the winding stem 11 is pressed inward to the third position (other function state) and the setting lever 45 is rotated, whereby the contact spring section 47*a* comes in contact with the other contact section 9*b* provided on the top surface of the circuit board 9, and the operating mode switches from the normal hand movement mode to another function mode, as shown in FIG. 13.

Note that the pressing plate 48 is attached together with the setting lever spring 46 to the housing 8 by a screw 48*a*, presses the setting lever spring 46 and the switch plate 47, and thereby rotatably presses the setting lever 45 against the housing 8, as shown in FIG. 10.

Next, effects of the switch device 10 in this electronic wristwatch will be described.

First, the normal hand movement state in which the rotating operation member 13 of the switch device 10 is not operated will be described. In the normal hand movement state, the rotating operation member 13 has been pressed inward towards the interior of the wristwatch case 1, and is being locked to the guide pipe 14 by the locking section 25, as shown in FIG. 2. That is, the female screw section 25*a* of the rotating operation member 13 has been fastened to the male screw section 25*b* of the guide pipe 14, thereby locking the rotating operation member 13.

Therefore, the rotating operation member 13 has been pressed inward towards the inner side of the wristwatch case 1, with the ring-shaped shoulder section 27*b* of the interlocking pipe 27 provided therein compressing the second coil spring 33 via the second sliding member 35, as shown in FIG. 2. In this state, the detachment-preventing shoulder section 24 of the rotating operation member 13 has come in contact with the stopper section 28*a* of the projecting section 28 in the winder section 18 of the pressing operation member 12 from the outer side, whereby the pressing operation member 12 has been pressed inward towards the inner side of the wristwatch case 1.

That is, the pressing operation member 12 has been pressed inward towards the inner side of the wristwatch case 1, with the winder section 18 of the pressing operation member 12 compressing the first coil spring 30 via the first sliding member 32, as shown in FIG. 2. Therefore, the shaft section 17 of the pressing operation member 12 has been pressed inward towards the inner side of the wristwatch case 1, within the guide pipe 14.

In this state, the position of the winding stem 11 is restricted to the first position (normal hand movement state) by the setting lever 45 of the position restricting member 40, and the switch plate 47 of the position restricting member 40 is positioned between the contact sections 9*a* and 9*b*, whereby the switch is in an OFF state in which the switch plate 47 is not in contact with either one of the contact sections 9*a* and 9*b*, as shown in FIG. 10.

Next, time adjustment by the rotation of the winding stem 11 will be described.

In this instance, first, the rotating operation member 13 is rotated and released from being locked to the guide pipe 14, as shown in FIG. 11. That is, when the rotating operation member 13 is rotated, the female screw section 25*a* of the rotating operation member 13 is unscrewed from the male screw section 25*b* of the flange section 16 of the guide pipe 14.

Figure 14:
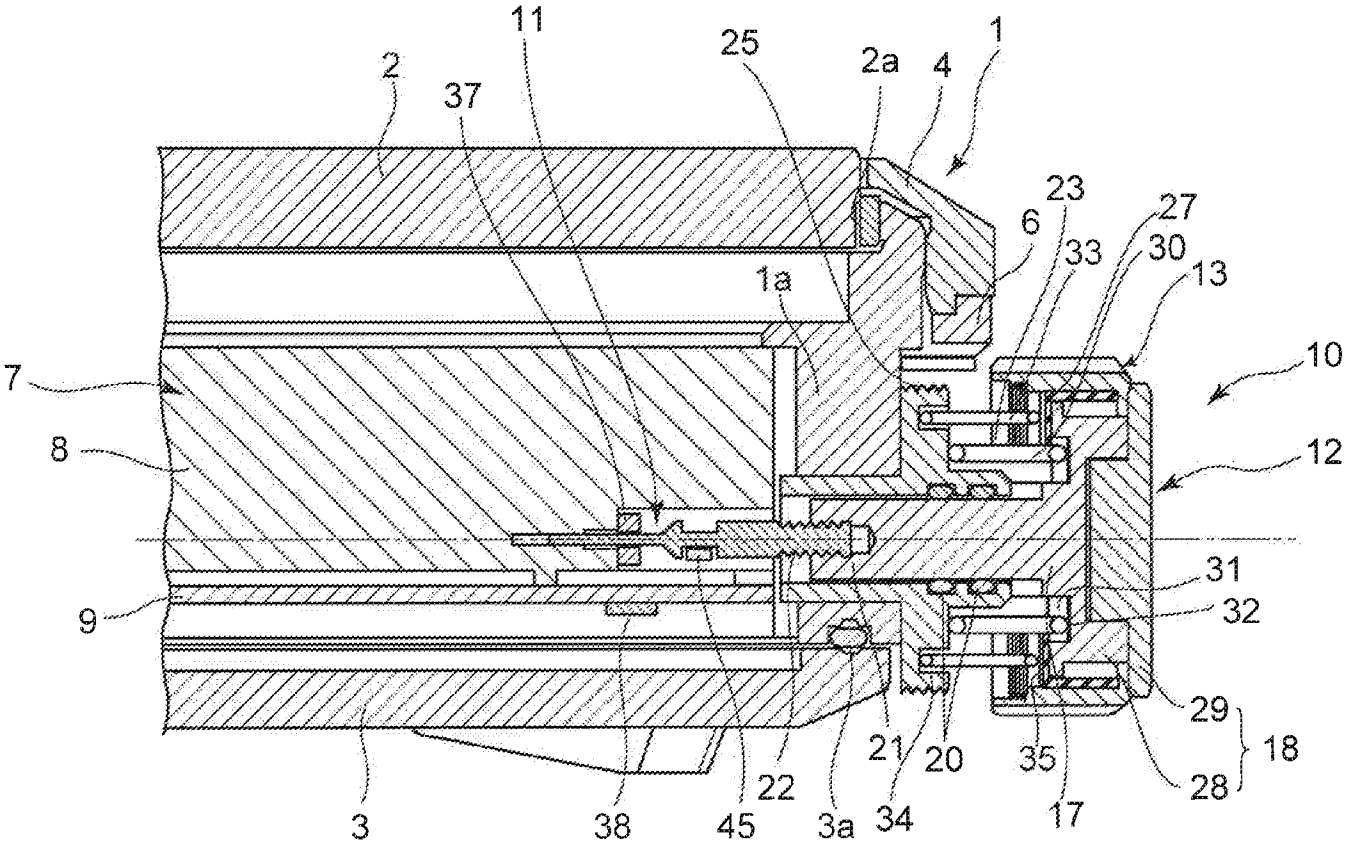
FIG. 14 is an enlarged cross-sectional view showing the main section of the switch device of the electronic wristwatch in FIG. 2, in which the rotating operation member has been pulled outward.

Here, along with the rotation operation for releasing the rotating operation member 13 from being locked, the rotating operation member 13 moves in a direction (right-hand side in FIG. 11) away from the wristwatch case 1 and is pressed outward by the spring force of the second coil spring 33. In addition, the pressing operation member 12 is pressed outward by the spring force of the first coil spring 30 along with the movement of the rotating operation member 13, and thereby slides in the same direction as the rotating operation member 13. Then, the detachment-preventing shoulder section 24 of the rotating operation member 13 comes in contact with the interlocking projecting section 29*b* of the operation section 29, as shown in FIG. 14.

In addition, because the screw section 22 of the winding stem 11 has been threadably engaged with the screw hole 21 provided in the shaft section 17 of the pressing operation member 12 and the winding stem 11 has been connected to the pressing operation member 12, the winding stem 11 slides in a direction in which the winding stem 11 is pulled outward, along with the sliding movement of the pressing operation member 12. Then, the setting lever 45 of the position restricting member 40 which is in engagement with the engaging groove section 43 of the winding stem 11 rotates along with the sliding of the winding stem 11, whereby the switch plate 47 is rotated and the contact spring section 45*a* of the switch plate 47 comes in contact with one contact section 9*a*, as shown in FIG. 12.

As a result, the switch enters its ON state and the mode switches from the normal hand movement mode to the time adjustment mode. Accordingly, the magnetic sensor 38 is turned ON and enters a state capable of detecting the magnetic field of the magnet 37 provided in the winding stem 11. In this state, when the rotating operation member 13 is rotated, the pressing operation member 12 rotates along with it. This rotation of the pressing operation member 12 is transmitted to the winding stem 11, and the winding stem 11 rotates together with the pressing operation member 12. Then, because the magnet 37 rotates together with the winding stem 11, a change in magnetic field accompanying the rotation of the magnet 37 is detected by the magnetic sensor 38 and, based on this detection result, the hands are moved for time adjustment.

In this state, even when the pressing operation member 12 is press-operated from outside, the mode is prevented from being switched. That is, when the pressing operation member 12 is press-operated against the spring force of the first coil spring 30, the winding stem 11 slides along with it in the direction in which the pressing operation member 12 is pressed. Then, by this sliding of the winding stem 11, the setting lever 45 of the position restricting member 40 which is in engagement with the engaging groove section 43 of the winding stem 11 is rotated, and the switch plate 47 is rotated thereby, as shown in FIG. 10. Accordingly, the contact spring section 47*a* of the switch plate 47 is moved and positioned between the contact sections 9*a* and 9*b* of the circuit board 9, whereby the switch enters its OFF state in which the switch plate 47 is not in contact with either one of the contact sections 9*a* and 9*b*, and the mode is not switched, as shown in FIG. 10.

After the time is adjusted as described above, the rotating operation member 13 of the switch device 10 is pressed inward again, and returned to and locked in the normal hand movement state in which it cannot be operated. In this instance, when pressing the rotating operation member 13 inward towards the wristwatch case 1 in the state shown in FIG. 11, the fingertips come into contact with the interlocking projecting section 29*b* of the operation section 29 in the winder section 18 of the pressing operation member 12, and presses the rotating operation member 13 inward towards the wristwatch case 1 side while pressing the interlocking projecting section 29*b*.

At this time, as a result of the interlocking projecting section 29*b* being pressed, the setting lever 45 of the position restricting member 40 which is in engagement with the engaging groove section 43 of the winding stem 11 rotates along with the sliding of the winding stem 11, whereby the switch plate 47 is rotated, the contact spring section 47*a* of the switch plate 47 is moved and positioned between the contact sections 9*a* and 9*b* of the circuit board 9, and the switch enters the OFF state in which the switch plate 47 is not in contact with either one of the contact sections 9*a* and 9*b*, as shown in FIG. 10. Accordingly, even when the rotating operation member 13 is inadvertently rotated, the magnetic sensor 38 does not detect change in magnetic field accompanying the rotation of the magnet 37, and therefore malfunction does not occur.

Next, function switching by a pressing operation of the pressing operation member 12 of the switch device 10 will be described.

In this instance, the rotating operation member 13 of the switch device 10 is locked in the normal hand movement state in which it cannot be operated, as shown in FIG. 2. In addition, the contact spring section 47*a* of the switch plate 47 is moved and positioned between the contact sections 9*a* and 9*b* of the circuit board 9, whereby the switch enters the OFF state in which the switch plate 47 is not in contact with either one of the contact sections 9*a* and 9*b*, or in other words, it enters the normal hand movement state, as shown in FIG. 10.

In the normal hand movement state, when the pressing operation member 12 is press-operated from outside, the pressing operation member 12 slides towards the inner side (left-hand side in FIG. 2) of the wristwatch case 1 against the spring force of the first coil spring 30, and the winding stem 11 is pressed inward along with the sliding of the pressing operation member 12, as shown in FIG. 2. Then, by the sliding of the winding stem 11, the setting lever 45 of the position restricting member 40 which is in engagement with the engaging groove section 43 of the winding stem 11 is rotated, and the switch plate 47 is rotated thereby, as shown in FIG. 13. Accordingly, the contact spring section 47*a* of the switch plate 47 comes in contact with the other contact section 9*b*, whereby the switch enters the ON state and switches from the normal hand movement mode to another function mode.

As described above, the switch device 10 of the electronic wristwatch includes the rotating operation member 13, the pressing operation member 12, the first coil spring 30, and the second coil spring 33. The rotating operation member 13 has the through-hole 23 formed in the axial direction. The pressing operation member 12 is movable within the through-hole 23 of the rotating operation member 13 and press-operable from one opening of the through-hole 23 that is provided so as to not slip out of the one opening of the through-hole 23. Further, the pressing operation member 12 integrally rotates with the rotating operation member 13 when rotating the rotating operation member 13. The first coil spring 30 is arranged within the through-hole 23 of the rotating operation member 13 and biases the pressing operation member 12 towards the one opening direction. The second coil spring 33 is arranged within the through-hole 23 of the rotating operation member 3 and biases the rotating operation member 13 towards the one opening direction. Therefore, a stable switching action can be performed and the switching operation can be improved.

That is, in the switch device 10, when the rotating operation member 13 is pulled outward and being rotated, it is rotated while being stably held by the spring force of the second coil spring 33, and the pressing operation member 12 is rotated in conjunction therewith while being stably held by the spring force of the first coil spring 30. Therefore, backlash does not occur during switching operation, and its switching action is performed stably. As a result, switching operation can be smoothly and favorably performed, whereby the operability is improved.

In addition, in the switch device 10, the first sliding member 32 is provided on a portion of the inner surface of the winder section 18 of the pressing operation member 12 with which the end portion of the first coil spring 30 on the outer end portion side comes in contact, and the first sliding member 32 slides the first coil spring 30 in the rotation direction when the rotating operation member 13 is rotated. Accordingly, in spite of the pressing operation member 12 being biased towards the outer end portion side by the spring force of the first coil spring 30, the rotating operation member 13 can be smoothly rotated with the pressing operation member 12 by the first sliding member 32 sliding the first coil spring 30 along the rotation direction when the rotating operation of the rotating operation member 13 is performed. Therefore, the rotating operation member 13 and the pressing operation member 12 can be smoothly rotated and the rotating operation can be favorably performed in spite of the first coil spring 30 being included.

Similarly, in the switch device 10, the second sliding member 35 is provided on a portion of the inner end surface of the shoulder section 27*b* of the interlocking pipe 27 in the rotating operation member 13 with which the end portion of the second coil spring 33 on the outer end portion side comes in contact, and the second sliding member 35 slides the second coil spring 33 in the rotation direction when the rotating operation member 13 is rotated. Therefore, in spite of the rotating operation member 13 being biased towards the outer end portion side by the spring force of the second coil spring 33, the rotating operation member 13 can be smoothly rotated with the pressing operation member 12 by the second sliding member 35 sliding the second coil spring 33 along the rotation direction when the rotating operation of the rotating operation member 13 is performed. Therefore, the rotating operation member 13 and the pressing operation member 12 can be smoothly rotated and the rotating operation can be favorably performed in spite of the second coil spring 33 being included.

In this instance, the second mounting groove 34 is a positioning part for positioning the second coil spring 33 that is provided in a place where at least one end portion is situated in one side of an opening and an end portion is situated in the other side of the opening for the second coil spring 33, and which correspond among the first coil spring 30 and the second coil spring 33, or in other words, a predetermined place of the flange section 16 of the guide pipe 14. Therefore, the second coil spring 33 can be arranged to be accurately positioned within the through-hole 23 of the rotating operation member 13, whereby the rotating operation member 13 can be favorably and stably held by the spring force of the second coil spring 33.

Similarly, the first mounting groove 31 is a positioning part for positioning the first coil spring 30 that is provided in a place where at least one end portion is situated in one side of an opening and an end portion is situated in the other side of the opening for the first coil spring 30, and which correspond among the first coil spring 30 and the second coil spring 33, or in other words, a predetermined place of the inner surface of the winder section 18 of the pressing operation member 12. Therefore, the first coil spring 30 can be arranged accurately to be positioned within the through-hole 23 of the rotating operation member 13, whereby the pressing operation member 12 can be favorably and stably held by the spring force of the first coil spring 30.

Also, the switch device 10 includes the interlocking pipe 27 for interlocking the rotating operation member 13 and the pressing operation member 12. Accordingly, when the rotating operation of the rotating operation member 13 is performed in a state where the pressing operation member 12 has been pressed outward by the spring force of the first coil spring 30, the interlocking pipe 27 interlocks the pressing operation member 12 with the rotating operation member 13 and rotates it in response to this rotating operation. In addition, when the pressing operation member 12 is press-operated against the spring force of the first coil spring 30 in this state, the interlocking pipe 27 slides the pressing operation member 12. Therefore, switching operation can be favorably performed.

That is, when the rotating operation of the rotating operation member 13 is performed in a state where the rotating operation member 13 has been pulled outward, since the recessing and projecting section 27*a* of the rotating operation member 13 and the recessing and projecting section 28*b* of the pressing operation member 12 are in engagement with each other, the interlocking pipe 27 transmits the rotation to the pressing operation member 12, whereby the pressing operation member 12 is favorably and unfailingly rotated. In addition, when the pressing operation member 12 is press-operated in this state, since the recessing and projecting section 27*a* of the rotating operation member 13 and the recessing and projecting section 28*b* of the pressing operation member 12 are in engagement with each other, the interlocking pipe 27 smoothly slides the pressing operation member 12 against the spring force of the first coil spring 30, whereby the pressing operation member 12 is favorably and unfailingly pressed inward.

Also, the switch device 10 includes the locking section 25 that locks the rotating operation member 13 in a state where the rotating operation member 13 has been pressed inward together with the pressing operation member 12 against the spring force of the first coil spring 30 and the spring force of the second coil spring 33. Therefore, inadvertent switching actions in the normal hand movement state can be reliably prevented.

That is, the locking section 25 includes the male screw section 25*b* provided on the outer peripheral portion of the flange section 16 of the guide pipe 14 in the side wall section la of the wristwatch case 1 and the female screw section 25*a* provided on the inner peripheral surface of the through-hole 23 of the rotating operation member 13. Therefore, the rotating operation member 13 can be unfailingly and favorably fixed and locked to the wristwatch case 1 by the rotating operation member 13 being rotated and the female screw section 25*a* being threadably engaged with the male screw section 25*b* of the flange section 16 of the guide pipe 14.

In addition, in the switch device 10 of the electronic wristwatch, the pressing operation member 12 projects to be outwardly movable from one opening of the through-hole 23 of the rotating operation member 13, and has the operation section 29 provided in the projecting outer end portion thereof which has been formed to be larger than the inner diameter of the through-hole 23. Therefore, switching operation can be favorably performed, and malfunction during switching operation can be prevented.

That is, in the switch device 10, the pressing area of the operation section 29 of the pressing operation member 12 is large when the operation section 29 is press-operated in a state where the rotating operation member 13 has been pressed inward. Therefore, the operation section 29 can be unfailingly and favorably press-operated. In addition, when being pressed inward after being pulled outward and rotated, the rotating operation member 13 can be pressed inward simultaneously with the operation section 29 to turn off the switch. Therefore, even if the rotating operation member 13 is inadvertently rotated when being pressed inward, malfunction of the switch is reliably prevented.

In this instance, the operation section 29 of the pressing operation member 12 has the interlocking projecting section 29*b* whose outer diameter is almost the same size as that of the rotating operation member 13. Therefore, when pressing the rotating operation member 13 inward after pulling it outward and rotating it, the fingertips holding the rotating operation member 13 naturally holds the interlocking projecting section 29*b* of the operation section 29 as well and presses it inward. Accordingly, the pressing operation member 12 can be slid and the switch can be turned OFF at this time. Therefore, even if the rotating operation member 13 is inadvertently rotated when being pressed inward, malfunction of the switch is reliably prevented.

In the above-described embodiment, the first sliding member 32 is arranged on the inner surface of the winder section 18 of the pressing operation member 12 to which the outer end portion side of the first coil spring 30 corresponds. However, the present invention is not limited thereto, and the first sliding member 32 may be arranged in the flange section 16 of the guide pipe 14 to which the inner end portion side of the first coil spring 30 corresponds. Alternatively, the first sliding member 32 may be arranged both on the inner surface of the winder section 18 of the pressing operation member 12 to which the outer end portion side of the first coil spring 30 corresponds and in the flange section 16 of the guide pipe 14 to which the inner end portion side of the first coil spring 30 corresponds.

In addition, in the above-described embodiment, the second sliding member 35 is arranged on the end surface in the inner section of the interlocking pipe 27 of the rotating operation member 13 to which the outer end portion side of the second coil spring 33 corresponds. However, the present invention is not limited thereto, and the second sliding member 35 may be arranged in the mounting groove 34 provided in the flange section 16 of the guide pipe 14 to which the inner end portion side of the second coil spring 33 corresponds. Alternatively, the second sliding member 35 may be arranged both on the end surface in the inner section of the interlocking pipe 27 to which the outer end portion side of the second coil spring 33 corresponds and in the mounting groove 34 provided in the flange section 16 of the guide pipe 14 to which the inner end portion side of the second coil spring 33 corresponds.

Moreover, in the above-described embodiment, the first sliding member 32 having a washer shape is arranged on the inner surface of the winder section 18 of the pressing operation member 12 to which the outer end portion side of the first coil spring 30 corresponds. However, the first sliding member 32 is not necessarily required to be in the shape of a washer. For example, the first sliding member 32 may be a surface-treated layer having low friction resistance, such as a Teflon layer or a plating layer, provided on the inner surface of the winder section 18 of the pressing operation member 12 to which the outer end portion side of the first coil spring 30 corresponds.

In this instance as well, the surface-treated layer may be provided in the flange section 16 of the guide pipe 14 to which the inner end portion side of the first coil spring 30 corresponds. Alternatively, the surface-treated layer may be provided both on the inner surface of the winder section 18 of the pressing operation member 12 to which the outer end portion side of the first coil spring 30 corresponds and in the flange section 16 of the guide pipe 14 to which the inner end portion side of the first coil spring 30 corresponds.

In addition, in the above-described embodiment, the second sliding member 35 having a washer shape is arranged on the end surface in the inner section of the interlocking pipe 27 of the rotating operation member 13 to which the outer end portion side of the second coil spring 33 corresponds. However, the second sliding member 35 is not necessarily required to be in the shape of a washer. For example, the second sliding member 35 may be a surface-treated layer having low friction resistance, such as a Teflon layer or a plating layer, provided on the end surface in the inner section of the interlocking pipe 27 to which the outer end portion side of the second coil spring 33 corresponds.

In this instance as well, the surface-treated layer may be provided in the flange section 16 of the guide pipe 14 to which the inner end portion side of the second coil spring 33 corresponds. Alternatively, the surface-treated layer may be provided both on the end surface in the inner section of the interlocking pipe 27 to which the outer end portion side of the second coil spring 33 corresponds and in the flange section 16 of the guide pipe 14 to which the inner end portion side of the second coil spring 33 corresponds.

Lastly, in the above-described embodiment and in each variation example of the embodiment, the present invention has been applied to a pointer-type electronic wristwatch. However, the present invention is not necessarily required to be applied to an electronic wristwatch and may be widely applied to various pointer-type electronic clocks, such as travel clocks, alarm clocks, mantelpiece clocks, and wall clocks. In addition, the present invention is not necessarily required to be applied to a pointer-type electronic wristwatch and may be applied to a digital-type electronic wristwatch having a display panel that electro-optically displays information such as the time.

While the present invention has been described with reference to the preferred embodiments, it is intended that the invention be not limited by any of the details of the description therein but includes all the embodiments which fall within the scope of the appended claims.

What is claimed is:

1. A switch device comprising:

a rotating operation member which has a through-hole formed therein in an axial direction;

a pressing operation member which is movable within the through-hole of the rotating operation member and which is press-operable from one opening of the through-hole, wherein the pressing operation member is provided so as to rotate integrally with the rotating operation member, when the rotating operation member rotates;

a first coil spring which is arranged within the through-hole of the rotating operation member and biases the pressing operation member outwardly in the axial direction;

a second coil spring which is arranged within the through-hole of the rotating operation member and biases the rotating operation member outwardly in the axial direction;

a locking section which locks the rotating operation member in a locked state in which the rotating operation member is inoperable to perform a function associated therewith, wherein when the locking section locks the rotating operation member in the locked state, the pressing operation member is operable to perform a function associated therewith, and when the locking section unlocks the rotating operation member so that the rotating operation member is in an unlocked state, the pressing operation member is inoperable to perform the function associated therewith.

2. The switch device according to claim 1, further comprising:

a first sliding member which is provided in an area corresponding to an end portion of the first coil spring on a side of the one opening; and a second sliding member which is provided in an area corresponding to an end portion of the second coil spring on a side of the one opening;

wherein the first sliding member and the second sliding member slide along the first coil spring and the second coil spring in a rotation direction, respectively, when the rotating operation member rotates.

3. The switch device according to claim 1, further comprising:

a positioning section which positions an end portion of the second coil spring on a side opposite to a side of the one opening.

4. The switch device according to claim 1, further comprising:

an interlocking member which interlocks the rotating operation member and the pressing operation member such that the pressing operation member rotates integrally with the rotating operation member and such that the pressing operation member is slidable within the rotating operation member, wherein when a rotating operation of the rotating operation member is performed in a state in which the rotating operation member is in the unlocked state and the pressing operation member has been pressed outward by a spring force of the first coil spring, the interlocking member interlocks the pressing operation member with the rotating operation member and causes the pressing operation member to rotate integrally with the rotating operation member in response to the rotating operation, and when the rotating operation member is in the locked state and the pressing operation member is press-operated against the spring force of the first coil spring, the pressing operation member slides along the interlocking member within the rotating operation member.

5. The switch device according to claim 1, wherein when the locking section locks the rotating operation member in the locked state, the rotating operation member is pressed inward with the pressing operation member in the axial direction, against a spring force of the first coil spring and a spring force of the second coil spring.

6. The switch device according to claim 1, wherein the pressing operation member projects outwardly in the axial direction from the one opening of the through-hole of the rotating operation member so as to be press-operable from outside of the one opening, and the pressing operation member has an operation section provided on a projecting outer end portion which is larger in diameter than an inner diameter of the through-hole.

7. The switch device according to claim 6, wherein the operation section of the pressing operation member has an interlocking projecting section whose outer diameter is less than an outer diameter of the rotating operation member and greater than the inner diameter of the through-hole.

8. The switch device according to claim 1, further comprising:

a switch plate which rotates when the pressing operation member is moved in the axial direction; and a contact section which comes in contact with the switch plate when the pressing operation member is press-operated in a state in which rotating operation member is in the locked state and the pressing operation member is operable to perform the function associated therewith.

9. The switch device according to claim 1, wherein:

the rotating operation member has a detachment-preventing shoulder section which prevents the pressing operation member from slipping out of the one opening of the through-hole, the pressing operation member has a stopper section, and an interlocking projection section which projects radially outward from a center of the pressing operation member, when the rotating operation member is in the locked state and the pressing operation member is operable to perform the function associated therewith, the stopper section of the pressing operation member is in contact with the detachment-preventing shoulder section when a pressing operation of pressing operation member is not performed, and the stopper section of the pressing operation member slides inwardly in the axial direction away from the detachment-preventing shoulder section when the pressing operation is performed; and when the rotating operation member is in the unlocked state and the pressing operation member is inoperable to perform the function associated therewith, the interlocking projection section of the pressing operation member is in contact with the detachment-preventing shoulder member.

10. The switch device according to claim 1, further comprising:

a switch plate which rotates when the pressing operation member is moved in the axial direction;

a first contact section which comes in contact with the switch plate when the rotating operation member is in the unlocked state, wherein the rotating operation member is rotatably operable to perform the function associated therewith when the first contact section is in contact with the switch plate; and a second contact section which comes in contact with the switch plate when the pressing operation member is press-operated in a state in which the rotating operation member is in the locked state, wherein the function associated with the pressing operation member is performed when the switch plate comes in contact with the second contact section due to the pressing operation member being press-operated;

wherein the switch plate is arranged so as to be at an intermediate position between the first and second contact sections when the rotating operation member is in the locked state and the pressing operation member is not press-operated; and wherein in a state in which the rotating operation member is in the unlocked state and the switch plate is in contact with the first contact section, when the pressing operation member is press-operated, the switch plate is moved to the intermediate position between the first and second contact sections so that the pressing operation member is inoperable to perform the function associated therewith.

11. A wristwatch comprising:

a wrist watch case;

a rotating operation member which has a through-hole formed therein in an axial direction;

a guide pipe member which is attached to a side wall portion of the wristwatch case so as to pass through an interior of the wristwatch to an exterior, wherein at least a portion of the guide pipe member is arranged within the through-hole of the rotating operation member;

a pressing operation member which is inserted into the guide pipe member, and which is movable within the guide pipe member and within the through-hole of the rotating operation member, wherein the pressing operation member is press-operable from one opening of the through-hole, and the pressing operation member is provided so as to rotate integrally with the rotating operation member, when the rotating operation member rotates;

a first coil spring which is arranged within the through-hole of the rotating operation member and biases the pressing operation member outwardly in the axial direction;

a second coil spring which is arranged within the through-hole of the rotating operation member and biases the rotating operation member outwardly in the axial direction; and a locking section which locks the rotating operation member in a locked state in which the rotating operation member is inoperable to perform a function associated therewith, wherein when the locking section locks the rotating operation member in the locked state, the pressing operation member is operable to perform a function associated therewith, and when the locking section unlocks the rotating operation member so that the rotating operation member is in an unlocked state, the pressing operation member is inoperable to perform the function associated therewith.

12. The wristwatch according to claim 11, further comprising:

a first sliding member provided in an area corresponding to an end portion of the first coil spring on a side of the one opening; and a second sliding member provided in an area corresponding to an end portion of the second coil spring on a side of the one opening;

wherein the first sliding member and the second sliding member slide along the first coil spring and the second coil spring in a rotation direction, respectively, when the rotating operation member rotates.

13. The wristwatch according to claim 11, wherein the guide pipe member is provided with a positioning section which positions an end portion of the second coil spring on a side opposite to a side of the one opening.

14. The wristwatch according to claim 11, further comprising:

an interlocking member which interlocks the rotating operation member and the pressing operation member such that the pressing operation member rotates integrally with the rotating operation member and such that the pressing operation member is slidable within the rotating operation member, wherein when a rotating operation of the rotating operation member is performed in a state in which in which the rotating operation member is in the unlocked state and the pressing operation member has been pressed outward by a spring force of the first coil spring, the interlocking member interlocks the pressing operation member with the rotating operation member and causes the pressing operation member to rotate integrally with the rotating operation member in response to the rotating operation, and when the rotating operation member is in the locked state and the pressing operation member is press-operated against the spring force of the first coil spring, the pressing operation member slides along the interlocking member within the rotating operation member.

15. The wristwatch according to claim 11, wherein when the locking section locks the rotating operation member in the locked state, the rotating operation member is pressed inward with the pressing operation member against a spring force of the first coil spring and a spring force of the second coil spring.

16. The wristwatch according to claim 11, wherein the pressing operation member projects outwardly in the axial direction from the one opening of the through-hole of the rotating operation member so as to be press-operable from outside of the one opening, and the pressing operation member has an operation section provided on a projecting outer end portion which is larger in diameter than an inner diameter of the through-hole.

17. The wristwatch according to claim 16, wherein the operation section of the pressing operation member has an interlocking projecting section whose outer diameter is less than an outer diameter of the rotating operation member and greater than the inner diameter of the through-hole.

18. The wristwatch according to claim 11, further comprising:

a switch plate which rotates when the pressing operation member is moved in the axial direction; and a contact section which comes in contact with the switch plate when the pressing operation member is press-operated in a state in which rotating operation member is in the locked state and the pressing operation member is operable to perform the function associated therewith.

19. The wristwatch according to claim 11, wherein:

the rotating operation member has a detachment-preventing shoulder section which prevents the pressing operation member from slipping out of the one opening of the through-hole, the pressing operation member has a stopper section, and an interlocking projection section which projects radially outward from a center of the pressing operation member, when the rotating operation member is in the locked state and the pressing operation member is operable to perform the function associated therewith, the stopper section of the pressing operation member is in contact with the detachment-preventing shoulder section when a pressing operation of pressing operation member is not performed, and the stopper section of the pressing operation member slides inwardly in the axial direction away from the detachment-preventing shoulder section when the pressing operation is performed; and when the rotating operation member is in the unlocked state and the pressing operation member is inoperable to perform the function associated therewith, the interlocking projection section of the pressing operation member is in contact with the detachment-preventing shoulder member.

20. The wristwatch according to claim 11, further comprising:

a switch plate which rotates when the pressing operation member is moved in the axial direction;

a first contact section which comes in contact with the switch plate when the rotating operation member is in the unlocked state, wherein the rotating operation member is rotatably operable to perform the function associated therewith when the first contact section is in contact with the switch plate; and a second contact section which comes in contact with the switch plate when the pressing operation member is press-operated in a state in which the rotating operation member is in the locked state, wherein the function associated with the pressing operation member is performed when the switch plate comes in contact with the second contact section due to the pressing operation member being press-operated;

wherein the switch plate is arranged so as to be at an intermediate position between the first and second contact sections when the rotating operation member is in the locked state and the pressing operation member is not press-operated; and wherein in a state in which the rotating operation member is in the unlocked state and the switch plate is in contact with the first contact section, when the pressing operation member is press-operated, the switch plate is moved to the intermediate position between the first and second contact sections so that the pressing operation member is inoperable to perform the function associated therewith.

* * * * *